US010494768B2

(12) United States Patent
Schildknecht et al.

(10) Patent No.: US 10,494,768 B2
(45) Date of Patent: Dec. 3, 2019

(54) METHOD FOR THE PRODUCTION OF HEAT-SEALING BARRIER PAPER

(71) Applicant: MUNKSJÖ OYJ, Helsinki (FI)

(72) Inventors: Laurent Schildknecht, Saint Laurent de Mure (FR); Séverine Schott, Saint-Julien-de-Ratz (FR); Pascale Escaffre, La Cote Saint Andre (FR)

(73) Assignee: Munksjö Oyj, Helsinki (FI)

( * ) Notice: Subject to any disclaimer, the term of this patent is extended or adjusted under 35 U.S.C. 154(b) by 432 days.

(21) Appl. No.: 15/500,217

(22) PCT Filed: Jul. 29, 2015

(86) PCT No.: PCT/EP2015/067437
§ 371 (c)(1),
(2) Date: Jan. 30, 2017

(87) PCT Pub. No.: WO2016/016339
PCT Pub. Date: Feb. 4, 2016

(65) Prior Publication Data

US 2017/0211236 A1 Jul. 27, 2017

(30) Foreign Application Priority Data

Jul. 30, 2014 (FR) ..... 14 57372

(51) Int. Cl.

| | |
|---|---|
| ***D21H 27/10*** | (2006.01) |
| ***B65B 9/20*** | (2012.01) |
| ***D21H 19/22*** | (2006.01) |
| ***D21H 19/38*** | (2006.01) |
| ***D21H 19/40*** | (2006.01) |
| ***D21H 19/54*** | (2006.01) |
| ***D21H 19/62*** | (2006.01) |
| ***D21H 19/82*** | (2006.01) |
| ***D21H 19/84*** | (2006.01) |
| ***D21H 27/16*** | (2006.01) |

(52) U.S. Cl.
CPC ..... *D21H 27/10* (2013.01); *B65B 9/20* (2013.01); *D21H 19/22* (2013.01); *D21H 19/385* (2013.01); *D21H 19/40* (2013.01); *D21H 19/54* (2013.01); *D21H 19/62* (2013.01); *D21H 19/826* (2013.01); *D21H 19/84* (2013.01); *D21H 27/16* (2013.01)

(58) Field of Classification Search
USPC ..... 162/135
See application file for complete search history.

(56) References Cited

U.S. PATENT DOCUMENTS

| | | | |
|---|---|---|---|
| 2,653,870 A | 9/1953 | Kast | |
| 4,018,647 A | 4/1977 | Wietsma | |
| 7,208,039 B2 | 4/2007 | Jones et al. | |
| 2004/0121079 A1 | 6/2004 | Urscheler et al. | |
| 2009/0239047 A1 | 9/2009 | Fugitt et al. | |
| 2009/0286090 A1 | 11/2009 | Ting et al. | |
| 2013/0004748 A1 | 1/2013 | Heiskanen et al. | |
| 2014/0113080 A1 | 4/2014 | Stinga et al. | |
| 2017/0211237 A1* | 7/2017 | Schildknecht | B65D 65/42 |

FOREIGN PATENT DOCUMENTS

| | | | |
|---|---|---|---|
| EP | 2777934 | A1 | 9/2014 |
| JP | S56-026246 | U | 3/1981 |
| JP | 2000-265395 | A | 9/2000 |
| JP | 2003-154609 | A | 5/2003 |
| JP | 2005-162213 | A | 6/2005 |
| JP | 2005-248394 | A | 9/2005 |
| JP | 2009-24288 | A | 2/2009 |
| JP | 2009-270203 | A | 11/2009 |
| JP | 2010-037693 | A | 2/2010 |
| JP | 2010-120323 | A | 6/2010 |
| JP | 2011-042089 | A | 3/2011 |
| JP | 2013-510222 | A | 3/2013 |
| JP | 2013-144363 | A | 7/2013 |
| JP | 2014-515439 | A | 6/2014 |
| WO | 00/05311 | A1 | 2/2000 |
| WO | 2008/141771 | A1 | 11/2008 |
| WO | 2009/112255 | A1 | 9/2009 |
| WO | 2009/117040 | A1 | 9/2009 |
| WO | 2010/052571 | A2 | 5/2010 |
| WO | 2011/056130 | A1 | 5/2011 |
| WO | 2013/069788 | A1 | 5/2013 |

OTHER PUBLICATIONS

Nov. 9, 2018 Office Action issued in U.S. Appl. No. 15/500,334.
Labscoop.com, Kaolin, 2018, obtained from http://www.labscoop.com/p/US-Biological-Kaolin/747180 (Year:2018).
Oct. 14, 2015 International Search Report issued in International Patent Application No. PCT/EP2015/067437.
Jan. 31, 2017 International Preliminary Report on Patentability issued in International Patent Application No. PCT/EP2015/067437.
Oct. 13, 2015 International Search Report issued in International Patent Application No. PCT/EP2015/067438.
Jan. 31, 2017 International Preliminary Report on Patentability issued in International Patent Application No. PCT/EP2015/067438.
U.S. Appl. No. 15/500,334, filed Jan. 30, 2017 in the name of Schildknecht et al.
Apr. 1, 2019 Office Action issued in Japanese Patent Application No. 2017-526012.
May 17, 2019 Office Action issued in U.S. Appl. No. 15/500,334.
Jul. 30, 2019 Office Action issued in Japanese Patent Application No. 2017-526011.

* cited by examiner

*Primary Examiner* — Mark Halpern
(74) *Attorney, Agent, or Firm* — Seppo Laine Oy

(57) ABSTRACT

The invention relates to a method for the production of a heat-sealable paper that forms a barrier to water vapour, in particular having a water vapour permeability of at most 150 g/m$^2$/24 h measured according to ASTM F1249 under so-called tropical conditions of 38° C. and 90% relative humidity, in which at least one coating layer comprising at least one thermoplastic film-forming polymer is applied in-line on the paper-making machine to the fibrous substrate.

34 Claims, No Drawings

METHOD FOR THE PRODUCTION OF HEAT-SEALING BARRIER PAPER

This application is a 371 of PCT/EP2015/067437 filed on 29 Jul. 2015

The present invention relates to the field of packaging papers.

Plastic films are widely used in flexible packagings since they possess water vapor barrier properties necessary for the proper preservation of perishable products or products that have a limited shelf life.

Papers are materials manufactured from fibres, generally cellulosic fibres, therefore of plant origin. They are naturally porous and permeable to gases and cannot, as is, be used for this application.

It is however known to combine papers with other materials (plastics, aluminium, etc.) in order to obtain the barriers necessary for packaging various products and in particular perishable foodstuffs. In this case, the paper substrate is subjected to conversion operations which include, for example, the coating of covering layers made of polymers in dispersion, the extrusion coating of molten polymers or the lamination with plastic or aluminium films. The cost of this paper-based composite having barrier properties has become expensive.

U.S. Pat. No. 2,653,870 A describes a process for manufacturing packaging paper.

Packagings made from barrier papers manufactured in-line are described in application WO 2011/056130. In-line manufacture is understood to mean the manufacture on a single production tool comprising all the elements required for the production of the paper.

However, the barrier level proposed is limited to measurement conditions that are not very restrictive (that are temperate, i.e. 25° C., 75% relative humidity). The barrier level is measured by a water vapor permeability, a weak barrier signifying a high water vapor permeability. It is known in the literature that "tropical" conditions (i.e. 38° C., 90% relative humidity) are much harsher than temperature conditions, and that therefore the barrier measured under temperate conditions is much weaker.

The expression "barrier paper" should be understood to mean a non-porous paper, comprising a fibrous substrate covered with one or more layers, which is sufficiently leaktight to water vapor to withstand the penetration thereof into the packaging, in an amount capable of adversely affecting the preservation of the product or the integrity of the product contained inside.

The invention is interested in particular, but not exclusively, in water vapor barrier papers having a water vapor permeability of at most 150 g/m$^2$/24 h and, preferably, of less than 100 g/m$^2$/24 h, measured according to the ASTM F1249 standard under so-called tropical conditions of 38° C. and 90% relative humidity.

It is advantageous for the barrier paper to also be heat-sealable, in order to allow the formation of the packaging by sealing the paper to itself.

The manufacture of heat-sealable papers involves, for example, laying a covering layer of a heat-sealing polymer on a cellulosic substrate. Such a covering layer has a quite strong tackiness when not dry, and must be able to be dried completely before the paper is wound on itself, to avoid the various turns of the reel sticking to one another.

The application of this covering layer is generally carried out off-line during one or more conversion steps, which makes it possible to have a good coating quality, to benefit from a paper at ambient temperature at the time of the coating which enables the covering layer not to penetrate into the fibrous support too much, and to be able to adapt the transit time of the reel width in the ovens, to a speed for example of the order of 200 m/min, so that the time of exposure to these heating means is sufficient to completely dry, in depth, the heat-sealing covering layer.

Documents US 2004/121079 A1, WO 2010/052571 A2, US 2014/113080 A1 and WO 2009/112255 A1 disclose papers that are treated off-line.

The papers that offer a barrier to water vapor and that are optionally heat-sealing are generally manufactured in the prior art during conversion operations and conventionally have covering layers of 10 to 30 g/m$^2$ when dry which are deposited as one or more thicknesses using various coating means (air knife, reverse gravure, Meyer rod or bar or any other coating method) or by the application of one thick layer using curtain coating.

The off-line conversion of a paper in order to give it water vapor barrier and heat-sealability properties is therefore an extra step in the manufacture of the paper which increases its costs significantly and which limits the development of paper in flexible packaging in favour of plastic film packaging. There is therefore an economic need to improve the productivity of the manufacture of water vapor barrier and heat-sealing papers.

The invention relates to the development of a paper endowed, during its in-line manufacture, with water vapor barrier and heat-sealability properties. This barrier and heat-sealing paper may be used for manufacturing packaging by sealing the paper to itself.

The invention aims, according to a first of its aspects, to meet this need and it achieves this by means of a process for manufacturing a heat-sealable water vapor barrier paper in which at least one covering layer comprising at least one thermoplastic film-forming polymer is applied in-line on the papermaking machine and to a fibrous substrate.

The invention makes it possible to obtain good water vapor barrier levels even with a weight of covering layer that does not exceed 10 g/m$^2$ when dry, in particular strictly less than 10 g/m$^2$.

This aspect of the invention is based on the observation that, despite the relatively high run speed of the paper imposed by an industrial papermaking machine, of the order for example of 400 m/min, the in-line coating of a composition intended to form a heat-sealing covering layer is possible, on condition that sufficient drying capacity is used to dry the layer before the winding operation. In particular, a relatively low weight of covering layer may facilitate the in-line drying, while providing sufficient barrier properties.

The invention therefore makes it possible, by means of an in-line process, to increase the productivity by eliminating the handling operations linked to the off-line treatment and by reducing the amount of waste.

Moreover, independently of the way in which the heat-sealing layer is applied, in-line or off-line, the problem is faced of facilitating the deposition of the heat-sealing layer and more generally of any covering layer, heat-sealing or not, applied to a fibrous substrate.

It is generally desirable for the covering layer not to penetrate too deeply into the fibrous substrate, in order to reduce the amount applied to the paper when this layer is polymer-based. Furthermore, a lesser penetration of the covering layer makes it possible to more easily create a barrier film.

The use of a Yankee cylinder is a first solution for reducing the surface porosity.

A second option is the use of a calender before any treatment of the paper.

Another option is to make provision for the presence of a precoat layer in order to reduce the porosity of the paper. This precoat layer may however not be present, and the covering layer may be applied to the fibrous substrate directly or after application of a pore-filling layer.

Another option is to combine one or other of the preceding options.

Use may be made, in the formulation of the precoat layer, of certain hydrophobic and highly film-forming latices.

However, the hydrophobic nature of the precoat layer may then pose a problem of wettability during the application of the covering layer, when the latter is aqueous, resulting in a not perfectly homogeneous covering of the precoated fibrous substrate by the covering layer, especially in the case of an in-line process with a high speed of the sheet. In addition, the surface energy of the precoat layer must be sufficiently different from that of the covering layer while complying with the well-known rules of wettability in order to reduce the risk of wetting defects.

Consequently, there remains a need to satisfactorily respond to the problem of the applicability of the covering layer.

The presence in this case of a precoat layer and, in the precoat layer, of a platy filler having a shape factor greater than 15 and of a finer, in particular non-platy, particulate filler, the size of the particles of which is, for 80% by weight, less than 2 μm (measured according to the ISO 13317-3 SediGraph method), makes it possible to obtain a relatively high barrier level, independently of the hydrophobic or non-hydrophobic nature of the binder.

It is known that platy fillers help to increase the barrier effect owing to the tortuosity that they provide, as taught for example by the document *Imerys Technical Guide, Pigments for Paper*, May 2008. The presence according to this aspect of the invention of at least one finer, in particular non-platy, particulate filler increases this effect. One tentative explanation is that this filler, by slipping between the platy particles, obstructs the movement of the water molecules even more, in particular around the platy particles. Document WO 2009/117040 A1 discloses clay platy fillers.

Owing to the barrier effect linked to the particular choice of the fillers present in the precoat layer, a greater freedom exists as regards the nature of the binder used.

It is thus possible to use, in particular, any papermaking binder with no particular barrier property, which makes it possible to obtain the two-fold advantage of a low water vapor permeability for the precoat layer and a good wettability with respect to the covering layer.

The invention makes it possible to have a reinforced barrier effect with the precoat layer, which allows a reduction in the amount of covering layer to be applied or, for an equal amount of covering layer, makes it possible to further increase the barrier level of the paper, which may prove useful for papers that have to be leaktight to water vapor. The reduction in the amount of covering layer needed, owing to the greater barrier power of the precoated paper, facilitates the drying thereof and may make the coating of this layer easier during the in-line manufacture of the paper.

The paper of the invention is preferably produced on a papermaking machine from a fibrous substrate consisting of cellulose fibres and optionally of synthetic fibres.

The cellulose fibres are in general a mixture of short fibres and long fibres.

Additives such as sizing agents, wet strength agents, retention agents or antifoams may be added.

The paper may also contain papermaking fillers such as titanium dioxide, kaolin, calcium carbonate and talc, inter alia.

The paper is preferably a packaging paper.

Another subject of the invention is a paper obtained by the process according to the invention.

Another subject of the invention is a packaging process in which an article is packaged by heat-sealing the paper obtained by the process according to the invention to itself, in particular at a production rate greater than or equal to 40 bags per minute, on vertical packaging machines of VFFS (Vertical Form, Fill and Seal) type, along longitudinal sealing lines of 330 mm per bag.

Precoat Layer

The precoat layer, when it is present, may be identical to the covering layer or be a pigment layer as defined below.

The precoat layer preferably consists of a mixture of at least one latex and of fillers also sometimes referred to as "pigments".

U.S. Pat. No. 4,018,647 A describes examples of latex.

The latex according to the invention preferably has a Tg (glass transition temperature) measured according to the ASTM E1356 standard of below 25° C. and more preferably of below 10° C. The latex may be selected from the latices of the following chemical natures: styrene-butadiene, styrene-acrylic, acrylic, butyl acrylate, butyl acrylate-styrene-acrylonitrile, etc., and more particularly from styrene-butadiene emulsions.

The amount of latex is preferably at least 15 parts when dry relative to the fillers when dry (100 parts), preferably at least, or even more than, 25 and better still 30 parts per hundred parts of filler.

The fillers preferably contain platy fillers and are preferably constituted by a mixture of platy filler(s) and finer, in particular non-platy, fillers.

The platy filler(s) are particles in the form of lamellae having a shape factor (ratio between greatest length and thickness) of greater than or equal to 15, more preferably of at least 40 and more preferably still of at least 60.

In particular, the precoat layer may comprise at least one platy filler having a shape factor of at least 15 and preferably a mixture of platy filler(s) having a shape factor of at least 15 and of finer, in particular non-platy filler(s), the particle size of which, for 80% by weight, is less than or equal to 2 μm, measured by the ISO 13317-3 SediGraph method.

In order to have a mixture of platy filler(s) and of finer filler(s), the particle size of which, for 80% by weight, is less than or equal to 2 μm, the particle size, for 80% by weight of platy filler(s) may for example be greater than 2 μm. According to another example, less than 80% by weight of platy particles may be less than or equal to 2 μm.

In other words, in order to have finer fillers than the platy filler(s), the finer fillers may, according to a first example, have a particle size smaller than that of the platy fillers at equivalent distribution by weight. According to a second example, they may have a greater distribution by weight for a same particle size than that of the platy fillers.

The finer fillers may be selected from all the other pigments used in papermaking, which meet the required size conditions.

The percentage of platy fillers relative to the sum of the fillers may vary from 10% to 90%, preferably from 40% to 90% and more preferably still from 60% to 90%.

The platy fillers may be selected, for example, from kaolin and talc, and mixtures thereof.

Between 30% and 80% by weight of platy particles may have a size less than or equal to 2 μm (measured according to the ISO 13317-3 SediGraph method).

The particles of the platy filler(s) are in particular oriented substantially parallel to the surface of the substrate.

The particles of the finer filler(s) may be selected from calcium carbonate, barium sulphate, silica, titanium dioxide and mixtures thereof, etc. They are characterized by a particle size, for 80% by weight, of less than 2 microns, measured according to the ISO 13317-3 SediGraph method.

The finer fillers may also be selected from any other pigment, including kaolin, having a sufficient fineness, in particular a particle size, for 95% by weight, of less than 2 microns, measured according to the ISO 13317-3 SediGraph method.

The binder is preferably selected from the aforementioned latices but other binders or co-binders such as PVOH, starch, CMC, etc. may be used. The binder may comprise a polymer of chemical nature not present in the covering layer.

Covering Layer

The polymers used to obtain the vapor barrier and the heat-sealability are preferably selected from polymers or copolymers based on PVdC (polyvinylidene chloride) or acrylic.

These polymers are applied pure or as a mixture with fillers. The term "pure" is understood to mean without particulate filler. Other products may optionally be added to the dispersion of polymers such as pH control agents, rheological (for example viscosifying) agents, antifoaming agents, wettability agents, etc.

The use of fillers within the covering layer may in particular help to reduce the risk of turns of the reel sticking to one another.

Manufacture

After drying the fibrous substrate, the paper sheet may pass on to a Yankee cylinder in order to improve the surface finish of the sheet and thus the distribution of the first layer.

The sheet may then be treated in a size press or any other equipment of the same type. To avoid too great a penetration of the precoat layer into the fibrous support, a pigment composition may be used beforehand in order to carry out "pore filling".

This pore-filling composition may contain up to 20 parts when dry, relative to the fillers when dry, of binder such as latex, of styrene-butadiene chemical nature for example, and up to 20 parts when dry, relative to the dry pigments, of co-binders such as starch for example.

This composition preferably contains fillers which have a size generally of less than 2 microns. These fillers may be selected, inter alia, from kaolins or calcium carbonates or mixtures thereof.

The precoat layer is applied to the support thus treated using any of the coating techniques that may be encountered on papermaking machines. This may in particular be blade coating, rotogravure coating, reverse gravure coating or Meyer rod coating. The precoat layer is deposited with a dry layer weight preferably of between 4 and 12 g/m$^2$.

This precoat layer is then dried without contact by one or more infrared ovens and/or one or more hot air ovens.

It is not necessary to have a very high level of smoothness before the application of the covering layer. A Bekk level of 150 seconds is sufficient (measured according to the ISO 5627 standard).

The water vapor barrier and heat-sealing covering layer is applied by coating using any of the coating techniques that may be encountered on papermaking machines. This may for example be blade coating, rotogravure coating, reverse gravure coating or Meyer rod coating. The covering layer is deposited with a dry layer weight preferably of 10 g/m$^2$ at most.

This covering layer is then sufficiently dried, to prevent the turns from sticking on the winding reel, using one or more infrared ovens and/or one or more hot air ovens.

Coating may be carried out on the opposite face in order to strengthen the barrier and/or in order to provide other functionalities such as printability, curl correction, etc.

The paper thus produced may optionally be calendered in-line in order to reduce the surface roughness before being wound.

The final basis weight of the paper may be between 45 and 200 g/m$^2$.

The barrier to water vapor measured according to the ASTM F1249 standard at 38° C. and 90% relative humidity is less than 150 g/m$^2$/24 h, and preferably less than 100 g/m$^2$/24 h.

EXAMPLE 1

A fibrous support having a basis weight of 55 g/m$^2$ is produced on a papermaking machine operating at 400 m/min. The papermaking machine is equipped with a Yankee cylinder placed before the size press.

The fibrous support is firstly glazed then treated in-line on both its faces by a size press with a pore-filling pigment composition, containing 100 dry parts of kaolin of Amazon Premium type (Cadam), and a mixture of Merifilm 104 starch (Tate&Lyle) and of latex of DL950 type (Dow) in a proportion of 20 dry parts relative to the dry kaolin. The treatment applied is 5 g/m$^2$ when dry in total.

It is then coated using a Meyer rod coater with a precoat formulation containing a mixture of platy fillers and of finer particulate fillers and a latex of styrene-butadiene chemical nature of Tg=7° C. (DL950 from Dow Chemical) and dried without contact in an infrared oven then a hot air oven. It is then wound on a reel with no other treatment. The dry weight of the precoat layer applied is 7 g/m$^2$ and its formulation is given in the table below:

| Material | Reference/Nature | Suppliers | Parts | wt % |
|---|---|---|---|---|
| Topsperse GX-N | Dispersant | COATEX | 0.2 | 0.2 |
| Capim NP | Kaolin (platy filler) | IMERYS | 60.0 | 45.5 |
| Amazon Premium | Kaolin (finer filler) | CADAM | 40.0 | 30.4 |
| Bacote 20 | Crosslinker | QUARRECHIM | 1.5 | 1.1 |
| DL950/Styrene-butadiene latex Tg 7° C. | Styrene-butadiene latex Tg 7° C. | DOW | 30.0 | 22.8 |

The particle size, for 97% by weight of Amazon Premium, measured according to the ISO 13317-3 SediGraph method, is less than 2 microns.

The shape factor of the Capim NP particles is 28.

The barrier to water vapor is measured by a Mocon Permatran 3/61 machine according to the ASTM F1249 standard at 38° C. and 90% relative humidity in order to determine the barrier contribution of this precoat layer. It is measured at 334±13 g/m$^2$/24 h. After coating with the covering layer, a barrier is obtained of less than 150 g/m$^2$/24 h.

EXAMPLE 2

A fibrous support having a basis weight of 55 g/m$^2$ is produced on a papermaking machine operating at 400 m/min. The papermaking machine is equipped with a Yankee cylinder placed before the size press.

The fibrous support is firstly glazed then treated in-line on both its faces by a size press with a pore-filling pigment composition, containing 100 dry parts of kaolin of Amazon Premium type (Cadam), and a mixture of Merifilm 104 starch (Tate&Lyle) and of latex of DL950 type (Dow) in a proportion of 20 dry parts relative to the dry kaolin. The treatment applied is 5 g/m$^2$ when dry in total.

It is then coated using a Meyer rod coater with a formulation containing a mixture of platy fillers and of finer particulate fillers and a latex of styrene-butadiene chemical nature of Tg=7° C. (DL950 from Dow Chemical) and dried without contact in an infrared oven then a hot air oven. It is then wound on a reel with no other treatment. The dry weight of the precoat layer applied is 7 g/m$^2$ and its formulation is given in the table below:

| Material | Reference/Nature | Suppliers | Parts | wt % |
|---|---|---|---|---|
| Topsperse GX-N | Dispersant | COATEX | 0.2 | 0.2 |
| Capim NP | Kaolin (platy filler) | IMERYS | 60.0 | 45.5 |
| Hydrocarb 95 | Calcium carbonate (finer filler) | OMYA | 40.0 | 30.4 |
| Bacote 20 | Crosslinker | QUARRECHIM | 1.5 | 1.1 |
| DL950/Styrene-butadiene latex Tg 7° C. | Styrene-butadiene latex Tg 7° C. | DOW | 30.0 | 22.8 |

The particle size, for 95% by weight of Hydrocarb 95, measured according to the ISO 13317-3 SediGraph method, is less than 2 microns.

The barrier to water vapor is measured by a Mocon Permatran 3/61 machine according to the ASTM F1249 standard at 38° C. and 90% relative humidity in order to determine the barrier contribution of this precoat layer. It is measured at 315±9 g/m$^2$/24 h. After coating with the covering layer, a barrier is obtained of less than 150 g/m$^2$/24 h.

EXAMPLE 3

A paper is produced in-line under the same conditions as in Example 1. But following the deposition of the precoat layer, it is coated in-line with a covering layer consisting of a dispersion of PVdC copolymer (Diofan A297 from Solvay), and dried without contact in an infrared oven then a hot air oven. It is then wound on a reel with no other treatment and no bonding between turns is observed. The dry weight of the covering layer is 6.5 g/m$^2$.

The barrier to water vapor is measured by a Mocon Permatran 3/61 machine according to the ASTM F1249 standard at 38° C. and 90% relative humidity. It is measured at 21.0±2.4 g/m$^2$/24 h.

The sealing is then simulated on a laboratory heat-sealing machine by bonding the face covered with the covering layer to itself at 110° C., under 3 bar and for 0.5 second. Next, the force necessary for detaching papers bonded to samples having a width of 15 mm is subsequently measured under an angle of 90 degrees according to the Tappi T540 standard at a speed of 100 mm/min.

A sealing force of 3.5 N/15 mm is obtained.

The invention is not limited to the examples described.

In summary, the invention may have the following advantageous features, alone or in combination:

- a precoat layer is applied in-line before the application of the covering layer to the precoat layer,
- the production speed of the paper is greater than or equal to 300 m/min, better still greater than or equal to 400 m/min, even better still greater than or equal to 500 m/min,
- a pore-filling composition is applied in-line to the fibrous substrate before the in-line application of any layer or precoat layer, the pore-filling composition being applied preferably by size press or by film press,
- the process comprises at least one in-line drying step then one in-line winding step, the heating power during the drying step being sufficient so that the covering layer is sufficiently dry during the winding step so that the turns of the reel do not stick together,
- the paper is brought during the drying of the fibrous substrate, before any surface treatment, in particular coating, into contact with a Yankee cylinder,
- the paper is brought during the drying of the covering layer into a zone where the drying takes place without contact, in particular using at least one infrared ramp and/or hot-air heating,
- the precoat layer comprises at least one platy filler having a shape factor of at least 15 and preferably a mixture of platy filler(s) having a shape factor of at least 15 and of in particular finer, in particular non-platy filler(s), the particle size of which, for 80% by weight, is less than or equal to 2 μm, measured by the ISO 13317-3 SediGraph method,
- the platy filler(s) and the finer filler(s) are of the same nature,
- the shape factor of the platy particles is at least 40, more preferably at least 60,
- the finer filler(s) have a particle size, for 95% by weight, of less than 2 microns,
- the platy filler(s) are mineral filler(s),
- the finer filler(s) are mineral filler(s),
- the platy filler(s) being selected from kaolins and talc and mixtures thereof,
- the finer filler(s) being selected from kaolins, calcium carbonate, barium sulphate, silica, titanium dioxide and mixtures thereof,
- the finer filler(s) being selected from kaolins,
- the dry weight of platy filler(s) being between 3% and 58% of the total dry weight of the precoat layer, the amount by weight of platy filler(s) preferably being greater than that of the finer fillers,
- the dry weight of finer filler(s) is between 3% and 58% of the total dry weight of the precoat layer,
- the percentage of platy fillers, expressed by dry weight, relative to the sum of the fillers, expressed by dry weight, being between 10% and 90%, preferably between 40% and 90% and more preferably still between 60% and 90%,
- the precoat layer may comprise a binder,
- the binder having a glass transition temperature $T_g$ below or equal to 25° C. and more preferably below or equal to 10° C., measured according to the ASTM E1356 standard,
- the binder being selected from latices of styrene-butadiene, styrene-acrylic, acrylic, butyl acrylate, butyl acrylate-styrene-acrylonitrile chemical nature, and preferably latices of styrene-butadiene chemical nature,
- the binder comprises a polymer of chemical nature not present in the covering layer,
- the binder being introduced in latex form,
- the amount of binder is of at least 15 parts when dry relative to the fillers when dry (100 parts) and preferably more than 25, better still 30 parts, a covering layer may be applied without calendering of the substrate covered by the precoat layer, the covering layer may be the only layer that covers the precoat layer, the covering layer may comprise one or more polymers selected from copolymers based on PVdC or on styrene-acrylic, the amount of precoat layer is less than or equal to 12 g/m$^2$ by dry weight, the amount of covering layer is less than or equal to 10 g/m$^2$ by dry weight, a layer, in particular a printing layer, is applied in-line on the papermaking machine to the face of the substrate opposite the one bearing the covering layer, the covering layer is constituted by a heat-sealable polymer, the water vapor permeability of the barrier paper is less than 150 g/m$^2$/24 h, better still less than 100 g/m$^2$/24 h, measured according to the ASTM F1249 standard under so-called tropical conditions at 38° C. and 90% relative humidity, the basis weight of the fibrous substrate is between 25 and 180 g/m$^2$, the paper is heat-sealable starting from 90° C., when the sealing is carried out by hot nip rolls, under 3 bar and for 0.5 s, the substrate bears two identical precoat layers on its opposite faces or two layers of different natures, between 30% and 80% by weight of platy particles have a size less than or equal to 2 μm (measured according to the ISO 13317-3 SediGraph method), the paper is heat-sealable, in particular to itself, at a production rate greater than or equal to 40 bags per minute, on vertical packaging machines of VFFS (Vertical Form, Fill and Seal) type, along longitudinal sealing lines of 330 mm per bag, the paper is heat-sealable to itself with a sealing force of greater than or equal to 2 N/15 mm, measured under an angle of 90 degrees according to the Tappi T540 standard at a speed of 100 mm/min, when the sealing is carried out by hot nip rolls, under 3 bar and for 0.5 s, the temperature of the fibrous substrate during the application of the precoat layer is greater than or equal to 50° C., the temperature of the fibrous substrate during the application of the covering layer is greater than or equal to 70° C., the final basis weight of the paper is between 45 and 200 g/m$^2$.

The expression "comprising a" should be understood as being synonymous with "comprising at least one".

The invention claimed is:

1. A process for manufacturing a heat-sealable water vapor barrier paper having a water vapor permeability of at most 150 g/m$^2$/24 h measured according to the ASTM F1249 standard under conditions of 38° C. and 90% relative humidity, in which at least one covering layer comprising at least one thermoplastic film-forming polymer is applied in-line on a papermaking machine and to a precoat layer, and in which the precoat layer is applied to a fibrous substrate in-line before the application of the covering layer to the precoat layer.

2. The process as claimed in claim 1, the production speed of the paper being greater than or equal to 300 m/min.

3. The process as claimed in claim 1, a pore-filling composition being applied in-line to the fibrous substrate before the in-line application of any layer or precoat layer.

4. The process as claimed in claim 1, the final basis weight of the paper being between 45 and 200 g/m$^2$.

5. The process as claimed in claim 1, comprising at least one in-line drying step then one in-line winding step, in which the heating power during the drying step is sufficient so that the covering layer is sufficiently dry during the winding step so that the turns of the reel do not stick together.

6. The process as claimed in claim 5, the paper being brought during the drying of the fibrous substrate, before any surface treatment into contact with a Yankee cylinder.

7. The process as claimed in claim 5, the paper being brought during the drying of the covering layer into a zone where the drying takes place without contact.

8. The process as claimed in claim 1, in which the precoat layer comprises a mixture of platy filler(s) having a shape factor of at least 15 and of finer, non-platy filler(s), the particle size of which, for 80% by weight, is less than or equal to 2 μm, measured by the ISO 13317-3 SediGraph method.

9. The process as claimed in claim 8, the platy filler(s) and the finer filler(s) being of the same nature.

10. The process as claimed in claim 8, the shape factor of the platy particles being at least 40.

11. The process as claimed in claim 8, the finer filler(s) having a particle size, for 95% by weight, of less than 2 microns.

12. The process as claimed in claim 8, the platy filler(s) being mineral filler(s).

13. The process as claimed in claim 8, the finer filler(s) being mineral filler(s).

14. The process as claimed in claim 8, the platy filler(s) being selected from kaolins and talc and mixtures thereof.

15. The process as claimed in claim 8, the finer filler(s) being selected from kaolins, calcium carbonate, barium sulphate, silica, titanium dioxide and mixtures thereof.

16. The process as claimed in claim 8, the finer filler(s) being selected from kaolins.

17. The process as claimed in claim 8, the dry weight of platy filler(s) being between 3% and 58% of the total dry weight of the precoat layer.

18. The process as claimed in claim 8, the dry weight of finer filler(s) being between 3% and 58% of the total dry weight of the precoat layer.

19. The process as claimed in claim 8, the percentage of platy filler(s), expressed by dry weight, relative to the sum of the fillers, expressed by dry weight, being between 10% and 90%.

20. The process as claimed in claim 1, the precoat layer comprising a binder comprising a polymer of chemical nature not present in the covering layer.

21. The process as claimed in claim 20, the binder having a glass transition temperature $T_g$ below or equal to 25° C. measured according to the ASTM E1356 standard.

22. The process as claimed in claim 20, the binder being selected from latices of styrene-butadiene, styrene-acrylic, acrylic, butyl acrylate, butyl acrylate-styrene-acrylonitrile chemical nature.

23. The process as claimed in claim 20, the binder being introduced in latex form.

24. The process as claimed in claim 20, the amount of binder being of at least 15 parts when dry relative to the fillers when dry (100 parts).

25. The process as claimed in claim 1, the covering layer being applied without calendering of the substrate covered by the precoat layer.

26. The process as claimed in claim 1, the covering layer being the only layer that covers the precoat layer.

27. The process as claimed in claim 1, the covering layer comprising one or more polymers selected from copolymers based on PVdC or on styrene-acrylic.

28. The process as claimed in claim 1, the amount of precoat layer being less than or equal to 12 $g/m^2$ by dry weight.

29. The process as claimed in claim 1, the amount of covering layer being less than or equal to 10 $g/m^2$ by dry weight.

30. The process as claimed in claim 1, in which a layer is applied in-line on the papermaking machine to the face of the fibrous substrate opposite the one bearing the covering layer.

31. The process as claimed in claim 1, the paper being heat-sealable at a production rate greater than or equal to 40 bags per minute, on vertical packaging machines of VFFS (Vertical Form, Fill and Seal) type, along longitudinal sealing lines of 330 mm per bag.

32. The process as claimed in claim 1, the paper being heat-sealable when the sealing is carried out by hot nip rolls, under 3 bar and for 0.5 s.

33. The process as claimed in claim 1, the paper being heat-sealable to itself with a sealing force of greater than or equal to 2 N/15 mm, measured under an angle of 90 degrees according to the Tappi T540 standard at a speed of 100 mm/min, when the sealing is carried out by hot nip rolls, under 3 bar and for 0.5 s.

34. A packaging process in which an article is packaged by heat-sealing the paper obtained by the manufacturing process as claimed in claim 1 to itself, at a production rate greater than or equal to 40 bags per minute, on vertical packaging machines of VFFS (Vertical Form, Fill and Seal) type, along longitudinal sealing lines of 330 mm per bag.

* * * * *